US006017251A

United States Patent [19]

Rittmann

[11] Patent Number: 6,017,251

[45] Date of Patent: Jan. 25, 2000

[54] EXTRUDED RAIL-MOUNT WITH SUPPORT LEG

[75] Inventor: Albert D. Rittmann, Russiaville, Ind.

[73] Assignee: Functional Devices, Inc., Russiaville, Ind.

[21] Appl. No.: 09/106,022

[22] Filed: Jun. 29, 1998

[51] Int. Cl.[7] ..... H01R 9/26

[52] U.S. Cl. ..... 439/716

[58] Field of Search ..... 439/716, 532; 248/229.1, 229.16, 229.26

[56] References Cited

U.S. PATENT DOCUMENTS

| | | | |
|---|---|---|---|
| 4,113,982 | 9/1978 | Glaesel | 174/158 R |
| 4,268,108 | 5/1981 | Debaigt | 339/198 GA |
| 4,900,275 | 2/1990 | Fasano | 439/716 |
| 5,090,922 | 2/1992 | Rymer | 439/716 |
| 5,145,418 | 9/1992 | Moranski | 439/716 |
| 5,192,227 | 3/1993 | Bales | 439/532 |

*Primary Examiner*—Renee S. Luebke
*Assistant Examiner*—Javaid Nasri

[57] ABSTRACT

An extruded rail-mount, for mounting devices to a variety of rails, with a support leg that provides upward support against the forceful pressure exerted when wires are screwed onto screw terminals at the edges of the mounted device. The mount is substantially constant longitudinally. The rail-mount has a thin, plank-like substrate with latitudinally upward arms and downward kinked legs and a downward support leg. The arms have catches to grab onto/support circuit boards or other devices. Kinked legs have catches to grab onto/mount a chosen rail. When the rail-mount is mounted on a rail, the support leg is of a length to support against the surface to which the rail is secured. Because rails are relatively narrow, the mount's utility is such that attachment to a rail provides support to one side of a mounted device and the support leg provides support for the opposite side of the device.

5 Claims, 3 Drawing Sheets

EXTRUDED RAIL-MOUNT WITH SUPPORT LEG

BACKGROUND OF INVENTION

This invention relates to rail mounting systems for electronic devices. More specifically, for DIN (Duetsche-Industrie-Norm) and NEMA (National Electrical Manufacturers Association) rail mounting systems.

These rail mounting systems are commonly used to support a variety of terminals, switches, relays, and can also support circuit boards by way of a mounting adapter. These rails are commonly longitudinally elongated, rigid, metal rails that are screw-attached to a base, like an inside surface of an enclosed cabinet. Different types of rails are defined by their dimensions and shape. These rails have standard and consistent dimensions invariable between manufacturers.

There are three prior art rails that my invention specifically relates/mounts to. These are DIN standard #EN 50035 (32 mm.), DIN standard #EN 50022 (35/7.5 mm.), and {22.4 mm×6.9 mm symmetrical NEMA A Series rails or DIN standard EN50045}. Examples of these rails can be seen in perspective view in FIG. 1 as notation 15, notation 16, and notation 17*a*, and 17*b* respectively. These rails can also be seen in FIG. 5 (notation 15), FIG. 6 (notation 16), and FIG. 7 (notation 17*a*) respectively. For easier understanding, these parts can be called: 'G', 'wide-hat', and 'small-hat' respectively. Though 22.4 mm×6.9 mm symmetrical NEMA A Series rails are slightly wider than DIN standard EN50045, the means for attaching to them is substantially equivalent in this text.

Other examples of these rails can be seen on p. 90 in the DIN Rail Electronic Modules catalog of LMI Connectors, Inc., 1181 S. Rogers Cir. #30, Boca Raton, Fla. 33487. Their part numbers EN 50 035 32 mm and EN 50 022 35/7.5 mm are examples of 'G' and 'wide-hat' respectively. Other examples of these rails can be seen on sales sheets 8-87 and 8-88 by Allen-Bradley Co., 1201 South Second Street, Milwaukee, Wis. 53204. Their part numbers 1492-DR2, (1492-DR5 and 199-DR1), and (1492-N1, 1492-N22, and 1492-DR3) are examples of 'G', 'wide-hat', and 'small hat' respectively.

In FIG. 1 an example of the orientation of all parts defined, shows 54 as a latitudinal edge, 53 as a longitudinal edge, and 55 as a transverse edge.

Common rails have transverse folds that can be called lips. The 'G' rail's lips face medially. The lips of the 'small-hat' and 'wide-hat' rails face peripherally. These lips provide a surface for a mount to fixedly attach.

Prior art rail circuit board mounts include that of Module Shells Series 991100.00 Extruded PVC on the same page of LMI Connectors, Inc. catalog. The "Locking Feet" part, that mounts to a variety of rails, is a molded part that slides into an extruded "Module Shell". The molded part is rigid and longitudinally short. Molded parts are considerably more expensive to tool for and produce than extrusions. The Locking Feet's rigidity makes it difficult to snap onto a rail. This is because tabs, that must catch under the rail to hold it, must temporarily move transversely to accept the rail. Flexibility is most important for attaching the 'G' and 'small-hat' rails because of the narrow transverse distance between the lip's edges. The rigidity of the molded Locking Feet also makes it difficult to purposely remove from a rail. Molded Locking Feet are longitudinally stubby to increase the feet's flexibility to accept a rail. At least two Locking Feet are needed to longitudinally support any mounted circuit board. Assembly of the Locking feet to the Module Shell involves a pair of triple-screw molded end-plates, creating additional production expense.

Prior art rail mounts include DIN Rail Mount, shown on p. 107 of 310-55-20M catalog by Altech Corp., 35 Royal Road, Flemmington, N.J. 08822. Again it is a molded part that attaches to a selected rail. Again an extruded part supports a circuit board and is attached to the molded part. Again a multi-part assembly, including a molded part, is expensive. Again, at least two molded parts are needed to longitudinally support any mounted circuit board. The limited latitude (height) of the extruded part does allow for easy cutting to a desired longitudinal length.

Prior art rail mounts include SNAPTRACK® 2/8TKD, shown in FIG. 2, derived from Form #040-0267 REV 1, by Augat RDI, 525 Randy Road, Carol Stream, Ill. 60188. SNAPTRACK® 2/8TKD is a single extruded, longitudinally long track to mount on 'G' and 'wide-hat' rails. This track is not now commercially available. This SNAPTRACK® is an inexpensive extrusion mount. The mount's flexibility and latitudinal raise (between where the rail lips will be) appears to allow for easy rail mounting and removal. It appears latitudinally short, which would make it easy to cut to a desired longitudinal length.

But there are disadvantages to this SNAPTRACK®. Commonly-mounted relay circuits have several screw terminals on their transversely peripheral edges. Wires must be screwed to these terminals after mounting. The excessive SNAPTRACK® flexibility and lack of support on the transversely peripheral edges makes the screwing nearly impossible. This may be why it is not now being produced. Also this SNAPTRACK® only adapts to two rails.

Augat RDI currently sells TKAD DIN Rail Adapter and 6TK2D SNAPTRACK®, shown in FIG. 3 (notations 52 and 51 respectively) derived from page 53 of 1995 catalog by Augat RDI. The TKAD DIN Rail Adapter is a semi-rigid molded part, making rail attachment difficult and rail removal nearly impossible, especially without a prying tool. The 6TK2D SNAPTRACK® extrusion is substantially flimsy. The Adapter is not transversely wide enough to support the extrusion's flimsy edges against the force of screwing to edge terminals on mounted circuit boards. The TKAD DIN Rail Adapter must be snapped into holes in extruded part 6TK2D SNAPTRACK®. This creates longitudinal track floppiness.

BRIEF DESCRIPTION OF THE INVENTION

An extruded rail-mount, for mounting devices to a variety of rails, with a support leg that provides upward support against the forceful pressure exerted when wires are screwed onto the edges of the mounted device. The mount is substantially constant longitudinally. The mount has a thin, plank-like substrate with latitudinally upward arms, downward kinked legs and a downward support leg. The arms have catches to grab onto/support circuit boards or other devices. Kinked legs have catches to grab onto/mount a chosen rail. When the rail-mount is mounted on a rail, the support leg is of a length to support against the surface to which the rail is secured. Because rails are relatively narrow, the mount's utility is such that attachment to a rail provides support to one side of a mounted device and the support leg provides support for the opposite side of the device.

ADVANTAGES OF THE INVENTION

My Extruded Rail-Mount is a one-piece, inexpensive extrusion. It easily and securely mounts to common rails (like 'G', 'wide-hat', and 'small-hat'). It can be purposely removed without tools. It can be cut along the transverse latitudinal plane to a desired longitudinal length. The substrate, and the kinked legs with catches that catch the rails, are all flexible. The arrangement of the catches allow for a single-height support leg. The unique support leg provides inexpensive and needed stability against the force of screwing to edge terminals on mounted circuit boards. As a flexible extrusion, half the catches to catch a rail can be substantially angular, providing for easy tilt-and-snap mounting.

DESCRIPTION OF THE NOTATIONS

Figure 1:
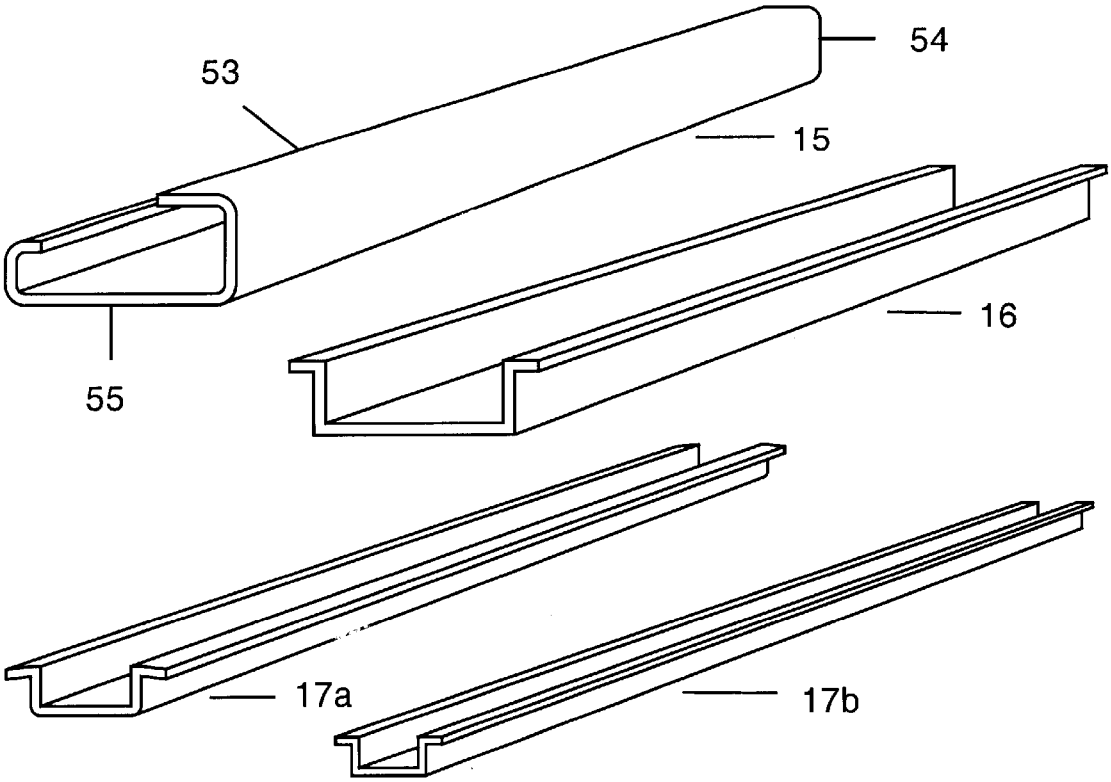
PRIOR ART FIG. 1
FIG. 1 is an assembly of prior art rails, perspective view
Figure 2:
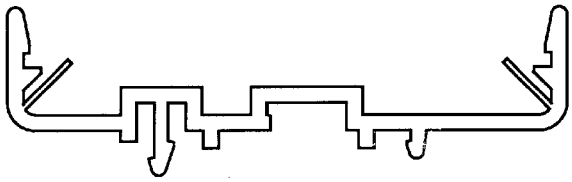
PRIOR ART FIG. 2
FIG. 2 is prior art 2/8TKD SNAPTRACK® by Augat RDI, plan view
Figure 3:
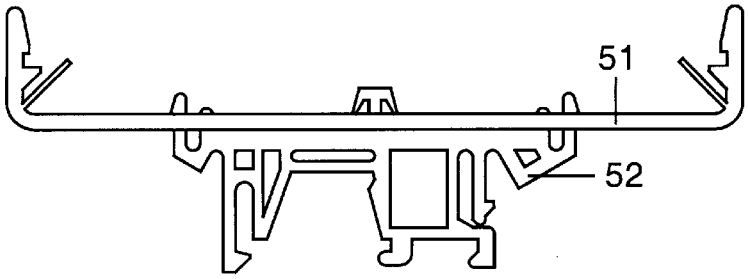
PRIOR ART FIG. 3
FIG. 3 is prior art 6TK2D SNAPTRACK® snapped to TKAD DIN Rail Adapter

1 is a left arm to support a circuit board
2 is a right arm to support a circuit board
3 is a catch to support a circuit board
4 is a catch to support a circuit board
5 is a left kinked leg on an embodiment
6 is a middle kinked leg on an embodiment
7 is a right kinked leg on an embodiment
8 is a support leg on an embodiment
9 is a catch to receive a 'G' rail lip
10 is a catch to receive a 'wide-hat' rail lip
11 is a catch to receive a 'G' rail lip
12 is a catch to receive a 'small-hat' rail lip
13 is a catch to receive a 'wide-hat' or 'small-hat' rail lip
15 is prior art 'G' rail
16 is prior art 'wide-hat' rail
17*a* is prior art 'small-hat' rail, 1492-N1 version
17*b* is prior art 'small-hat' rail, 1492-DR3 version
18 a transversely central phantom line
19 is a prior art circuit board (a device)
20 are left side prior art screw terminals
21 are right side prior art screw terminals
22 is the substrate of an embodiment
28 is a surface to which a rail is fixedly attached
38 is a surface to which a rail is fixedly attached
48 is a surface to which a rail is fixedly attached
51 is Augat RDI SNAPTRACK® 6TK2D
52 is Augat RDI SNAPTRACK® TKAD
53 is a longitudinal edge
54 is a latitudinal edge
55 is a transverse edge

DETAILED DESCRIPTION OF THE INVENTION

A. An Embodiment of the Invention

Figure 4:
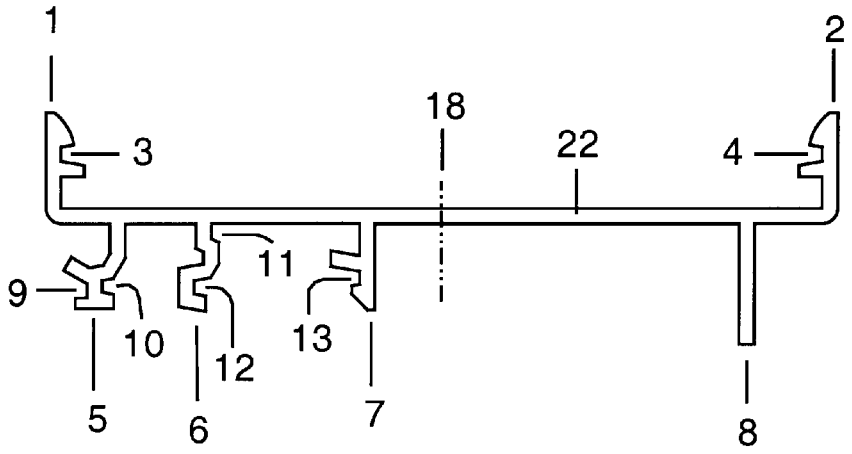
FIG. 4 is an embodiment of my Extruded Rail-Mount, plan view

FIG. 4 shows an embodiment of my Extruded Rail-Mount, plan view. Arms 1 and 2 project latitudinally upward from substrate 22 and are fixed thereto. Arms 1 and 2, in combination, provide catches 3 and 4 respectively as a prior art means to attach and secure a circuit board. The catches have uniquely open bottom lips for the benefit of the flexible substrate. Latitudinally downward projecting left kinked leg 5, middle kinked leg 6, and right kinked leg 7 are fixed to the substrate by means of extrusion. Kinked legs 5, 6, and 7 are of a size and shape to support catches. Catch 9 and 10 are on leg 5. Catch 11 and 12 are on leg 6. Catch 13 is on leg 7. Catches 9 and 11 are of a size and shape to receive a 'G' rail. Catches 10 and 13 are of a size and shape to receive a 'wide-hat' rail. Catches 12 and 13 are of a size and shape to receive a 'small-hat' rail. In this embodiment, catch 12 is in a position to receive the larger version of the 'small hat' rail (17*a* in FIG. 1). Since catch 12 only receives a 'small hat', catch 12 may be extrusion molded transversely to the right (≈0.7 cm.) (not shown) from where it is pictured to accommodate the smallest version of the 'small hat' (EN50045 or 17*b* in FIG. 1). Other alternative versions (not shown) may accommodate other rails (not specified here) by altering the arrangement of the kinked legs and their catches.

Kinked legs 5, 6, and 7 are transversely closer to arm 1 than to arm 2. Support leg 8 is transversely closer to arm 2 than to arm 1. A mounted circuit board with transversely peripheral screw terminals usually needs forceful downward latitudinal pressure to screw on many wires. My Extruded Rail-Mount, mounted on a rail by way of kinked legs 5, 6, and 7, provides left side support against this downward latitudinal pressure. Support leg 8 provides right side support against this downward latitudinal pressure.

B. Mounting an Embodiment

Figure 5:
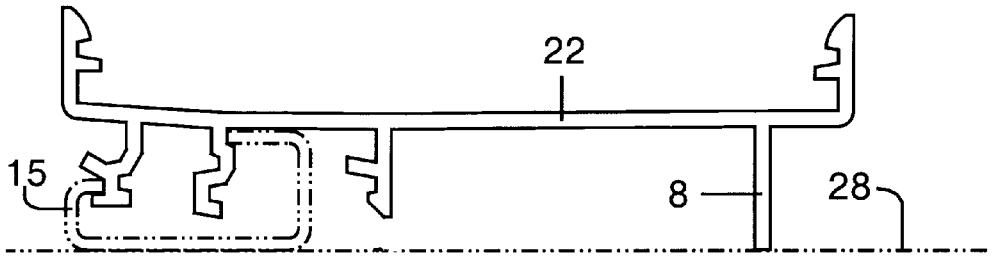
FIG. 5 is the embodiment of FIG. 4 mounted to prior art 'G' rail, plan view

FIG. 5 shows the embodiment of FIG. 4 mounted to prior art 'G' rail (15), plan view. The 'G' rail is fixedly attached to surface 28. The rail provides the left side support, and support leg 8 provides right side support against surface 28. My substrate (22) bends slightly latitudinally upward by leg 8. This bending provides for an extra firm grip to a to-be-mounted circuit board. This bending keeps the board in place latitudinally, transversely, and longitudinally.

Figure 6:
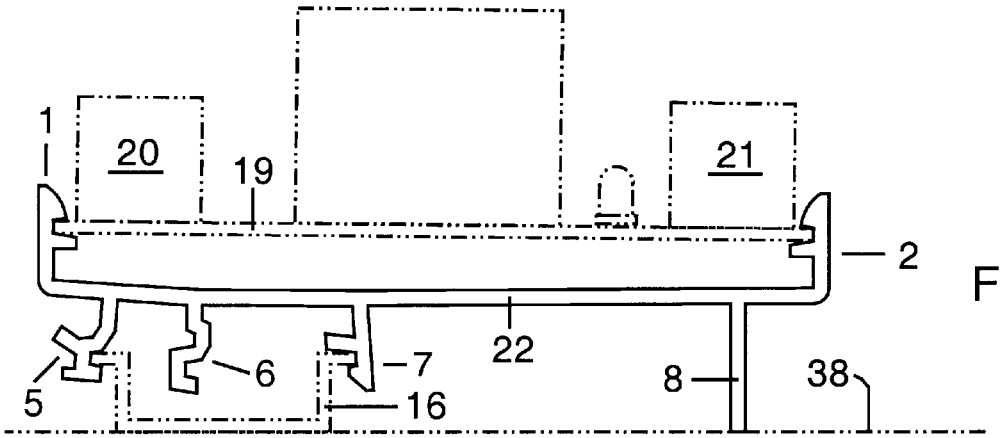
FIG. 6 is the embodiment of FIG. 4 mounted to prior art 'wide-hat' rail, and mounted with prior art circuit board, plan view

FIG. 6 is the embodiment of FIG. 4 mounted to prior art 'wide-hat' rail (16). My Extruded Rail-Mount is mounted with a prior art circuit board 19 with screw terminals 20 and 21, plan view. The 'wide-hat' rail is fixedly attached to surface 38. Again, the rail provides the left side support and support leg 8, resting on surface 38, provides right side support, and substrate 22 bends slightly latitudinally upward by leg 8. The arrangement provides plenty of support for screwing to terminals 20 and 21. Prior art circuit board 19 is an example of a mountable device. Circuit board 19 is mounted by way of arms 1 and 2. Other devices (not shown) may also be mounted by way of arms 1 and 2. Instead of arms, other means to mount a device may be used (not shown).

Figure 7:
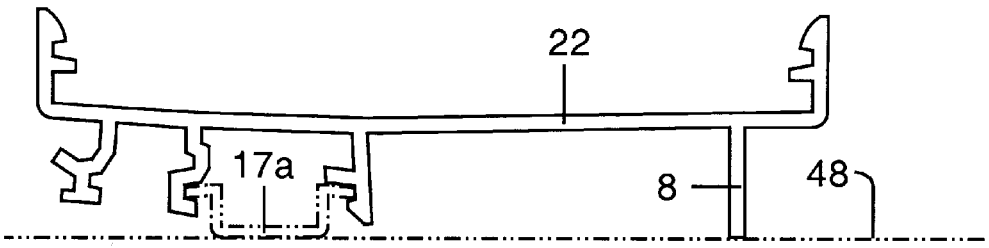
FIG. 7 is the embodiment of FIG. 4 mounted to prior art 'small-hat' rail, plan view

FIG. 7 is the embodiment of FIG. 4 mounted to prior art 'small-hat' rail (17*a*), plan view. Again support leg 8 slightly bends the substrate 22 upward latitudinally away from surface 48.

Figure 8:
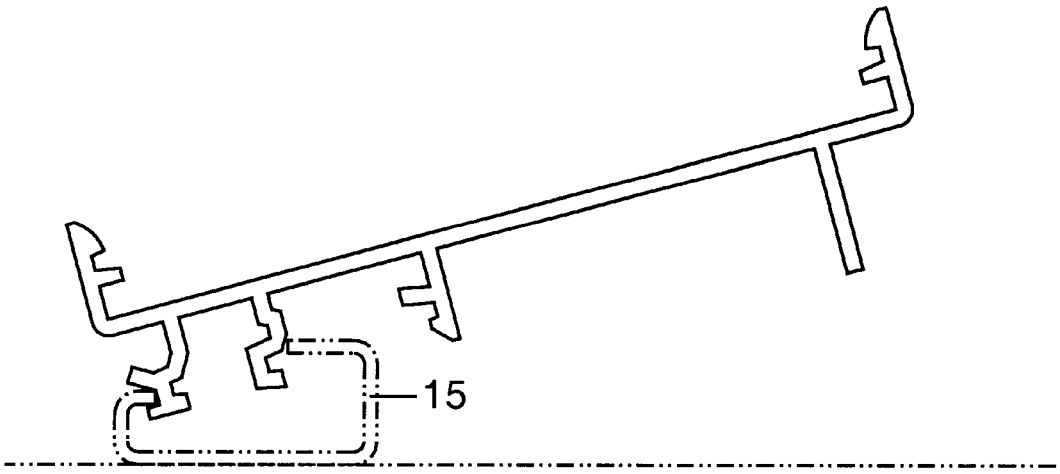
FIG. 8 is the embodiment of FIG. 4 being mounted to prior art 'G' rail, plan view
Figure 9:
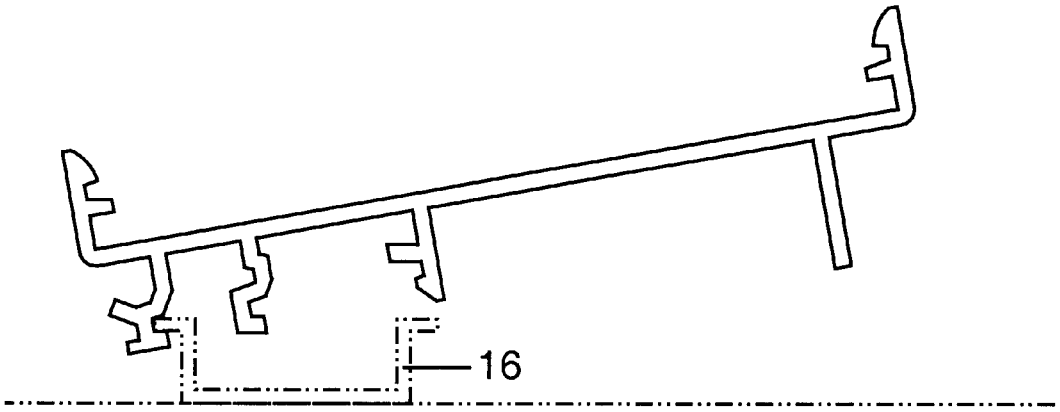
FIG. 9 is the embodiment of FIG. 4 being mounted to prior art 'wide-hat' rail, plan view
Figure 10:
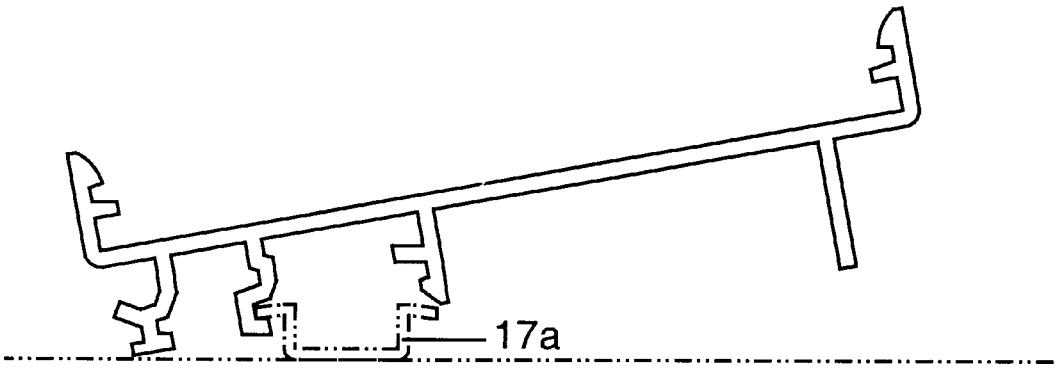
FIG. 10 is the embodiment of FIG. 4 being mounted to prior art 'small-hat' rail, plan view

My Extruded Rail-Mount of FIG. 4 attaches to all three rails in a similar way. Attachment to 'G' rail (15) is shown in FIG. 8. Attachment to 'wide-hat' rail (16) is shown in FIG. 9. Attachment to 'small-hat' rail (17*a*) is shown in FIG. 10. In all three figures, the right side of my Extruded Rail-Mount is positioned latitudinally upward. The left side lip of the rail is inserted into the appropriate left side's catch. The middle of the substrate is then pressed laterally downwards, which snaps the connector into position. In this embodiment of my Extruded Rail-Mount the left catch for each rail can be substantially angular, providing for easy tilt-and-snap mounting.

In the embodiment shown, all catches on both arms and legs have similar shapes and functions; in that the arms, legs and/or substrate bend to receive, then support latitudinally, longitudinally, and transversely.

C. Other Embodiments (not shown)

FIG. 4 shows a transversely wide substrate to accommodate transversely wide circuit boards. To accommodate even wider boards, the substrate may be transversely widened, like from transversely central phantom line 18. The substrate may be widened from this line such that: legs 5, 6, and 7 remain substantially close to the substrate's transversely left peripheral edge; and support leg 8 remains substantially close to the substrate's transversely right peripheral edge. The legs remain close to the substrate's edges for mounted circuit board edge terminal screwing.

The exact positioning of kinked leg combination 5, 6, and 7, and support leg 8 is not critical. The utility of my rail-mount is such that kinked leg attachment to a rail provides support to one side of a mounted device and the support leg provides support for the opposite side of the device.

D. A Functional Description of the Invention

My extruded rail-mount (like that in FIG. 6) can also be described functionally. My rail-mount is substantially constant longitudinally, with a substantially flat substrate (22), a peripherally attached pair of latitudinally upward arms (1 and 2), three kinked legs (5, 6, and 7), and a support leg (8). The embodiment in the figure is shown mounted to one of three possible varieties of rails (rail 16 is shown). Only two kinked legs are needed to mount any one rail, therefore my rail-mount may be made with only two legs (two leg version not shown). In this figure, only kinked legs 5 and 7 are needed. My mount may have more than three kinked legs to accommodate rails not called out in this text (this version is not shown).

My rail-mount mounts to a rail that is mounted to a surface (like surface 38 in this figure), In this figure my rail-mount is mounted by a device (19). The kinked legs, by mounting to the rail, provide upward latitudinal support for the transversely left side/edge of the device. The support leg, by supporting against the surface to which said rail is attached, provides upward latitudinal support for the transversely right side/edge of the device. These side/edge supports act against the great latitudinally downward pressure needed to screw wires to edge terminals (20 and 21) on the mounted device.

E. An Alternative Description of the Invention

FIG. 4 can be alternatively described as follows. My Extruded Rail-Mount is substantially constant longitudinally. Substrate 22 is relatively latitudinally short, and transversely wide. Left arm 1 and right arm 2 extend latitudinally upward from the substrate's transverse left and right most peripheral edges respectively and are fixed thereto. Legs 5, 6, 7, and 8 extend latitudinally downward from the substrate and are fixed thereto.

Left arm 1 supports substantially U-shaped catch 3, open transversely to the right. Right arm 2 supports substantially U-shaped catch 4, open transversely to the left. The arms provide a prior art means to mount a circuit board. Transversely from left to right, leg 5 is the left kinked leg, leg 6 is the middle kinked leg, leg 7 is the right kinked leg, and leg 8 is the support leg. Left kinked leg 5 supports substantially U-shaped catch 9 which opens transversely to the left, and substantially U-shaped catch 10 which opens transversely to the right. Middle kinked leg 6 supports substantially U-shaped catches 11 and 12, which open transversely to the right. Right kinked leg 7 supports substantially U-shaped catch 13 which opens transversely to the left.

My Extruded Rail-Mount is an extrusion. The flexibility of the extrusion, and the transverse narrowness of the kinked legs, provides a means for the catches to accept a rail and a circuit board.

All U-shaped catches that engage the left lip of the rail are substantially angular. This provides for easy tilt-and-snap mounting to a rail.

All kinked legs are positioned transversely left of the substrate's center, shown as phantom line 18. Support leg 8 is positioned transversely right of the substrate's center.

Legs 5, 6, and 7 are relatively the same height latitudinally. Leg 8 is latitudinally slightly taller than either leg 5, 6, or 7. Latitudinally, catch 11 is positioned above catches 9, 10, 12, and 13. Catches 9, 10, 12, and 13 are positioned substantially at the same latitudinal height.

Because my Extruded Rail-Mount is substantially longitudinally constant, my mount can also be described by latitudinal and transverse plane in mirror image.

F. Materials

My rail-mount could be made of a variety of suitable and flexible materials including, but not limited to rigid PVC (polyvinyl chloride) or ABS (acrylonitrile butadiene styrene).

I claim:

1. An extruded, substantially longitudinally constant rail-mount comprising:

a transversely elongated substrate having a means to attach a device, a left kinked leg, a middle kinked leg, a right kinked leg, and a support leg fixed thereto;

said kinked legs and said support leg extending downward latitudinally;

said left kinked leg, in combination with said middle kinked leg and said substrate of a size, shape, and flexibility to receive a 'G' rail;

said left kinked leg, in combination with said right kinked leg and said substrate of a size, shape, and flexibility to receive a 'wide-hat' rail;

said middle kinked leg, in combination with said right kinked leg and said substrate of a size, shape, and flexibility to receive a 'small-hat' rail;

said support leg of a size and shape to rest on a surface to which one of said rails is attached when said rail is mounted by said rail-mount; and said substrate, in combination with said means to attach a device, are of a size, shape, and flexibility to receive a device.

2. The extruded, substantially longitudinally constant rail-mount, according to claim 1, wherein:

said means to attach a device are a left arm and a right arm; and said arms extending upward latitudinally.

3. An extruded rail-mount having substantially longitudinally uniform thickness comprising a transversely elongated substrate having a transverse center and transverse right and left peripheral edges;

said substrate having a means to attach a device;

said substrate having a left kinked leg, a middle kinked leg, a right kinked leg, and one support leg fixed thereto;

said legs extending vertically downward from said substrate;

said left kinked leg being positioned transversely to the left of said middle kinked leg;

said middle kinked leg being positioned transversely to the left of said right kinked leg;

said right kinked leg being positioned transversely to the left of said support leg;

said left kinked leg having a substantially U-shaped catch open transversely to the right, and a substantially U-shaped catch open transversely to the left;

said middle kinked leg having two substantially U-shaped catches open transversely to the right;

said right kinked leg having a substantially U-shaped catch open transversely to the left;

said kinked legs being positioned transversely left of said substrate's said center;

said support leg being positioned transversely right of said substrate's said center;

said kinked legs being relatively the same height vertically;

said support leg being of a vertical height exceeding that of said kinked legs; and one said catch on said middle kinked leg being positioned vertically above all other said catches.

4. The extruded rail-mount according to claim 3, wherein said means to attach a device is a transversely right arm and a transversely left arm fixed thereto on said substrate's right and left peripheral edges respectively;

said arms extending vertically upward from said substrate;

said left arm having a substantially U-shaped catch open transversely to the right; and said right arm having a substantially U-shaped catch open transversely to the left.

5. An extruded rail-mount having substantially longitudinally uniform thickness comprising, two vertically downward kinked legs, and a vertically downward support leg such that;

when a rail is mounted to a surface, and said kinked legs mount to said rail:

said kinked legs providing upward vertical support for one transverse side of said rail-mount; and said support leg providing upward vertical support for the opposing transverse side of said rail-mount against said surface.

* * * * *